US010838322B2

(12) United States Patent
Tsuji et al.

(10) Patent No.: US 10,838,322 B2
(45) Date of Patent: Nov. 17, 2020

(54) TONER CONVEYING DEVICE AND IMAGE FORMING APPARATUS

(71) Applicant: KYOCERA Document Solutions Inc., Osaka (JP)

(72) Inventors: Hirofumi Tsuji, Osaka (JP); Masahiro Ueno, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/667,573

(22) Filed: Oct. 29, 2019

(65) Prior Publication Data

US 2020/0142335 A1 May 7, 2020

(30) Foreign Application Priority Data

Nov. 6, 2018 (JP) ..... 2018-209028

(51) Int. Cl.
*G03G 15/08* (2006.01)
*G03G 21/00* (2006.01)

(52) U.S. Cl.
CPC ..... *G03G 15/0891* (2013.01); *G03G 21/0011* (2013.01); *G03G 21/0029* (2013.01); *G03G 2221/0068* (2013.01); *G03G 2221/1618* (2013.01); *G03G 2221/1624* (2013.01)

(58) Field of Classification Search
CPC ..... G03G 15/0891; G03G 2221/0068; G03G 2221/1618; G03G 2221/1624; G03G 21/0011; G03G 21/0029
See application file for complete search history.

(56) References Cited

U.S. PATENT DOCUMENTS 3,917,398 A * 11/1975 Takahashi ..... G03G 21/0029 399/350
2004/0265024 A1* 12/2004 Naruse ..... G03G 21/0017 399/350
2010/0143011 A1* 6/2010 Tawada ..... G03G 21/007 399/358

FOREIGN PATENT DOCUMENTS

JP 2007034340 A 2/2007
JP 2017194597 A 10/2017

* cited by examiner

*Primary Examiner* — Ryan D Walsh
(74) *Attorney, Agent, or Firm* — Studebaker & Brackett PC

(57) ABSTRACT

A toner conveying device includes a case, a conveying screw, a film member and a supporting member. The conveying screw conveys a toner stored in the case in a predetermined direction inside the case. The film member includes a base part elongated in an axial direction of the conveying screw as a longitudinal direction and a plurality of protruding pieces formed so as to protrude in one direction intersecting the longitudinal direction from the base part, and has flexibility. The supporting member includes an attaching part elongated in the axial direction as the longitudinal direction to which the film member is attached, and an axis part being in parallel to the longitudinal direction. The film member and the supporting member are disposed at an upper side of the conveying screw so that the protruding pieces come into contact with the conveying screw, and are rotatable around the axis part.

8 Claims, 7 Drawing Sheets

COMPARATIVE EXAMPLE

COMPARATIVE EXAMPLE

COMPARATIVE EXAMPLE

TONER CONVEYING DEVICE AND IMAGE FORMING APPARATUS

INCORPORATION BY REFERENCE

This application is based on and claims the benefit of priority from Japanese Patent application No. 2018-209028 filed on Nov. 6, 2018, the entire contents of which are incorporated herein by reference.

BACKGROUND

The present disclosure relates to a toner conveying device conveying a toner and an image forming apparatus including this toner conveying device.

An image forming apparatus of an electrographic manner includes a cleaning device removing a toner remained on a photosensitive drum after transferring of a toner image. The cleaning device includes a cleaning blade scraping the toner from the photosensitive drum, a cleaning case storing the scraped toner, and a conveying screw conveying the toner stored inside the cleaning case in a predetermined direction. The cleaning device is an example of a toner conveying device conveying the toner.

In the above-mentioned cleaning device, there are problems that the toner adhered on a shaft of the conveying screw is firmly adhered and conveying function is deteriorated. Particularly, in recent years, because, for the purpose of improvement of energy saving, a low melting point of the toner has been promoted, the toner tends to be flocculated and to deteriorate its fluidity, and then, to be firmly adhered on the shaft.

Thereupon, in a conventional image forming apparatus, technique of releasing firmly adhesion of the toner onto a conveying screw is considered. For example, there is an image forming apparatus removing the toner from a shaft of the conveying screw by a film member. The film member has a base part formed to be elongated in an axial direction of the conveying screw, and a protruding piece formed to be protruded from the base part in a direction crossing the axial direction. The protruding piece is pressed to the conveying screw, and then, the toner is removed.

Toner removing performance of the above-mentioned film member more improves, the stronger pressing force pressing the protruding piece to the conveying screw. In order to strengthen the pressing force of the above-mentioned film member, because the base part is bonded to a cleaning case, it is necessary to heighten flexural rigidity (stiffness) of the film member and to enlarge elastic force of the film member against deflection. In order to heighten flexural rigidity of the film member, a way of thickening a thickness of the film member may be considered. The thickener the thickness of the film member, durability of the film member is more heightened. However, if flexural rigidity of the film member is heightened, it is feared that deflection occurs in the conveying screw, a blade part of the conveying screw comes into contact with an inner face of the cleaning case to cause allophone, or rotation of the conveying screw is disturbed. In order to restrain deflection of the conveying screw, if the thickness of the film member is thinned to reduce flexural rigidity, toner removing performance and durability are deteriorated. Therefore, in the conventional image forming apparatus, it is extremely difficult to simultaneously achieve all of improvement of toner removing performance, improvement of durability, and restraining of deflection of the conveying screw.

SUMMARY

In accordance with the present disclosure, a toner conveying device includes a case, a conveying screw, a film member and a supporting member. The case stores a toner. The conveying screw conveys the toner stored in the case in a predetermined direction inside the case. The film member includes a base part elongated in an axial direction of the conveying screw as a longitudinal direction and a plurality of protruding pieces formed so as to protrude in one direction intersecting the longitudinal direction from the base part, and has flexibility. The supporting member includes an attaching part elongated in the axial direction of the conveying screw as the longitudinal direction to which the film member is attached, and an axis part being in parallel to the longitudinal direction. The film member and the supporting member are disposed at an upper side of the conveying screw so that the protruding pieces come into contact with the conveying screw, and are rotatable around the axis part.

In accordance with the present disclosure, an image forming apparatus includes the toner conveying device as described above, an image forming part transferring a toner image formed on an image carrier onto a sheet, and a cleaning blade scraping the toner remained on the image carrier.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the accompanying drawings, a printer 1 (an example of an image forming apparatus) and a toner conveying device according to an embodiment of the present disclosure will be described.

Figure 1:
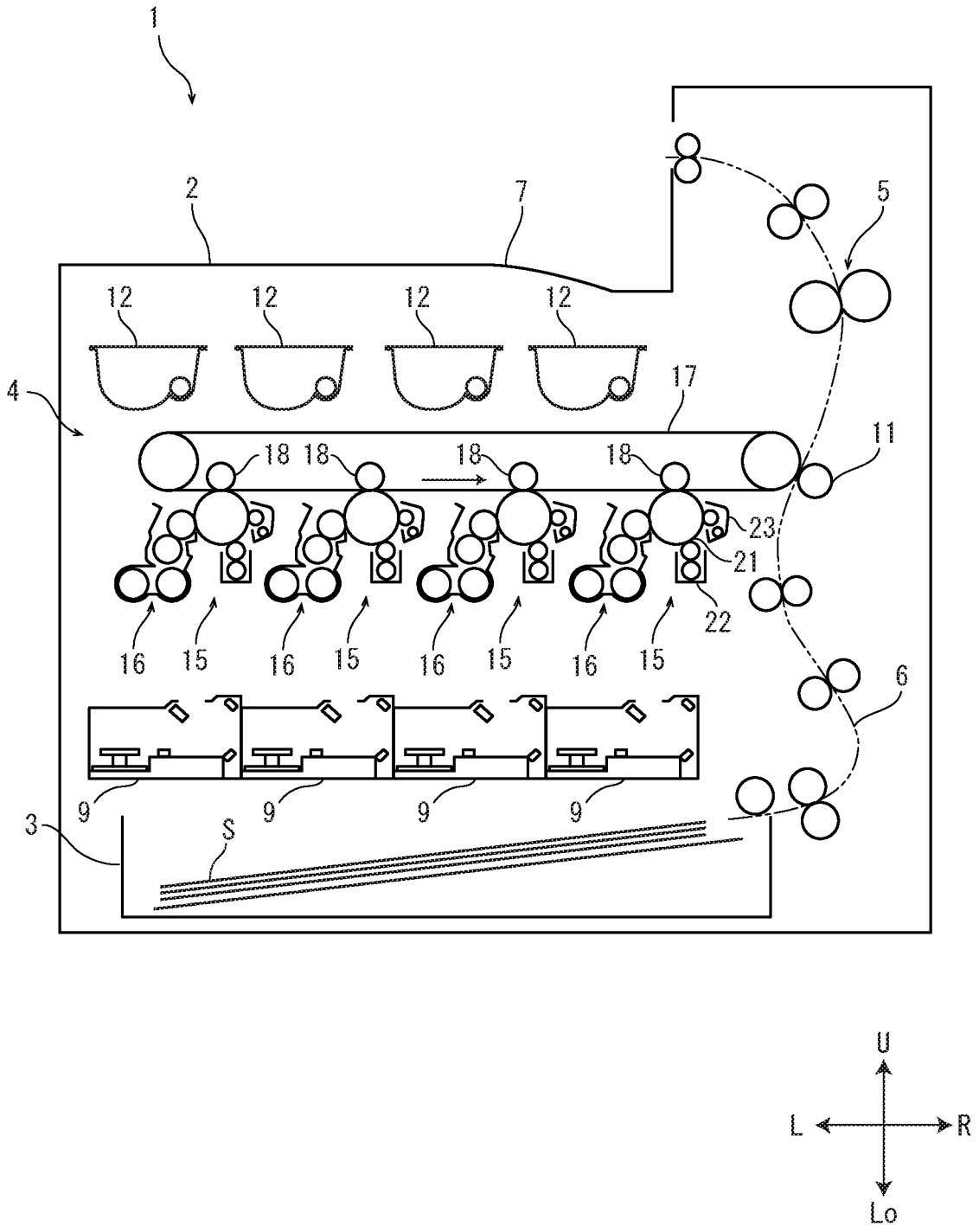
FIG. 1 is a sectional view schematically showing an internal structure of a printer according to an embodiment of the present disclosure.

First, with reference to FIG. 1, an entire configuration of the printer 1 will be described. FIG. 1 is a sectional view schematically showing an internal structure of the printer 1. Hereinafter, it will be described so that the front side of the printer 1 is positioned at a near side on a paper sheet of FIG.

1 and that left and right directions is defined as seen from the front side of the color printer 1. Arrows U, Lo, L, R, Fr and Rr in each of the drawings respectively indicate an upper side, a lower side, a left side, a right side, a front side and a rear side of the printer 1.

In a housing 2 of the printer 1, a sheet feeding device 3 feeding a stored sheet S to a conveying path 6, an image forming part 4 forming a toner image on the sheet S, a fixing device 5 fixing the toner image onto the sheet S, and an ejecting part 7 ejecting the sheet S having the fixed toner image are provided.

The image forming part 4 includes drum units 15, exposing devices 9, toner containers 12, developing units 16, an intermediate transferring belt 17, primary transferring rollers 18, and a secondary transferring roller 11.

The drum unit 15 includes a rotationally driven photosensitive drum 21 (an example of an image carrier), a charging device 22 electrically charging the photosensitive drum 21, a cleaning device 23 (an example of a toner conveying device) cleaning a surface of the photosensitive drum 21.

The exposing device 9 irradiates the photosensitive drum 21 with a laser light on the basis of image data. The toner containers 12 respectively contain toners of black, cyan, magenta and yellow.

The developing unit 16 includes a developing case, a magnetic roller, and a conveying screw. Between the developing case and the toner container 12, a supplying path (not shown) for the toner is provided, and the developing case stores the toner supplied from the toner container 12. The magnetic roller is disposed so as to be exposed from an opening of the developing case and to face to the conveying screw and the photosensitive drum 21.

The intermediate transferring belt 17 is an endless belt wound around a driving roller and a following roller, is disposed so that an outer face of the intermediate transferring belt 17 faces to the photosensitive drum 21, and is cyclically run. The primary transferring roller 18 is disposed so as to face to an inner face of the intermediate transferring belt 17, and sandwiches the intermediate transferring belt 17 with the photosensitive drum 21.

The secondary transferring roller 11 is disposed to faces to the outer face of the intermediate transferring belt 17 across the conveying path 6.

Next, an image forming operation of the printer 1 will be described. When the printer 1 receives the image data from an external device or the like, the sheet S is fed from the sheet feeding device 3 to the conveying path 6. On the surface of each of the electrically charged photosensitive drums 21, a latent image on the basis of the image data of black, cyan, magenta or yellow is formed by each of the exposing devices 9. In each of the developing devices 16 each of the developing devices 16, the toner stored in the developing case is supplied to the magnetic roller by the conveying screw. This toner is adsorbed to the latent image, and thereby, the toner image is formed on the photosensitive drum 21. The toner images carried on the respective photosensitive drums 21 are transferred on the intermediate belt 17 by the respective primary transferring rollers 18 in layers. The toner images transferred on the intermediate belt 17 are transferred on the sheet S by the secondary transferring roller 11, and are fixed onto the sheet S by the fixing device 5. The sheet S having the fixed toner images is ejected by the ejecting part 7. The toner remained on the surface of each photosensitive drum 21 is removed by each cleaning device 23.

Figure 2:
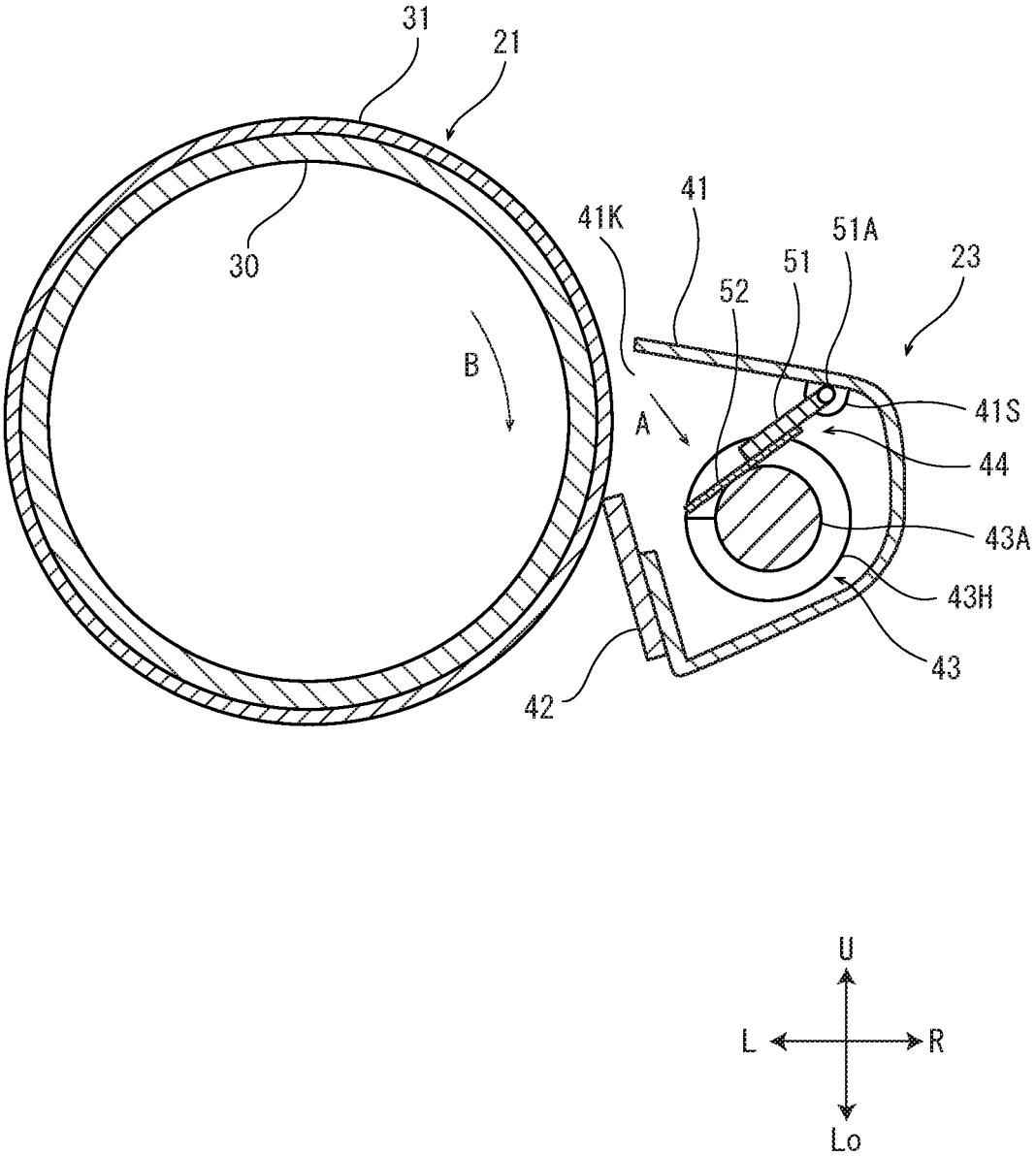
FIG. 2 is a sectional view showing a photosensitive drum and a cleaning device according to the embodiment of the present disclosure.
Figure 3:
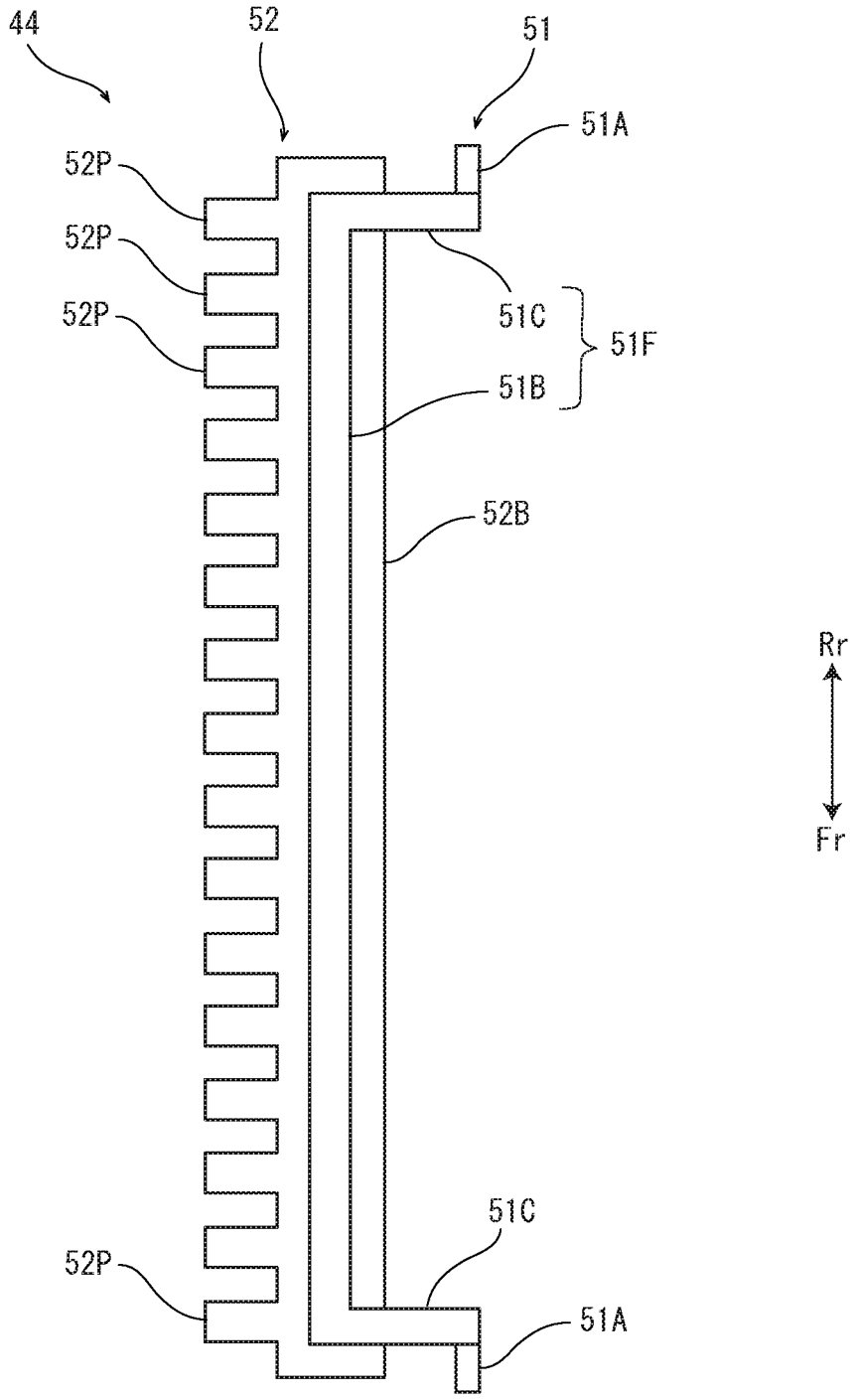
FIG. 3 is a planar view showing a scraping part according to the embodiment of the present disclosure.
Figure 4:
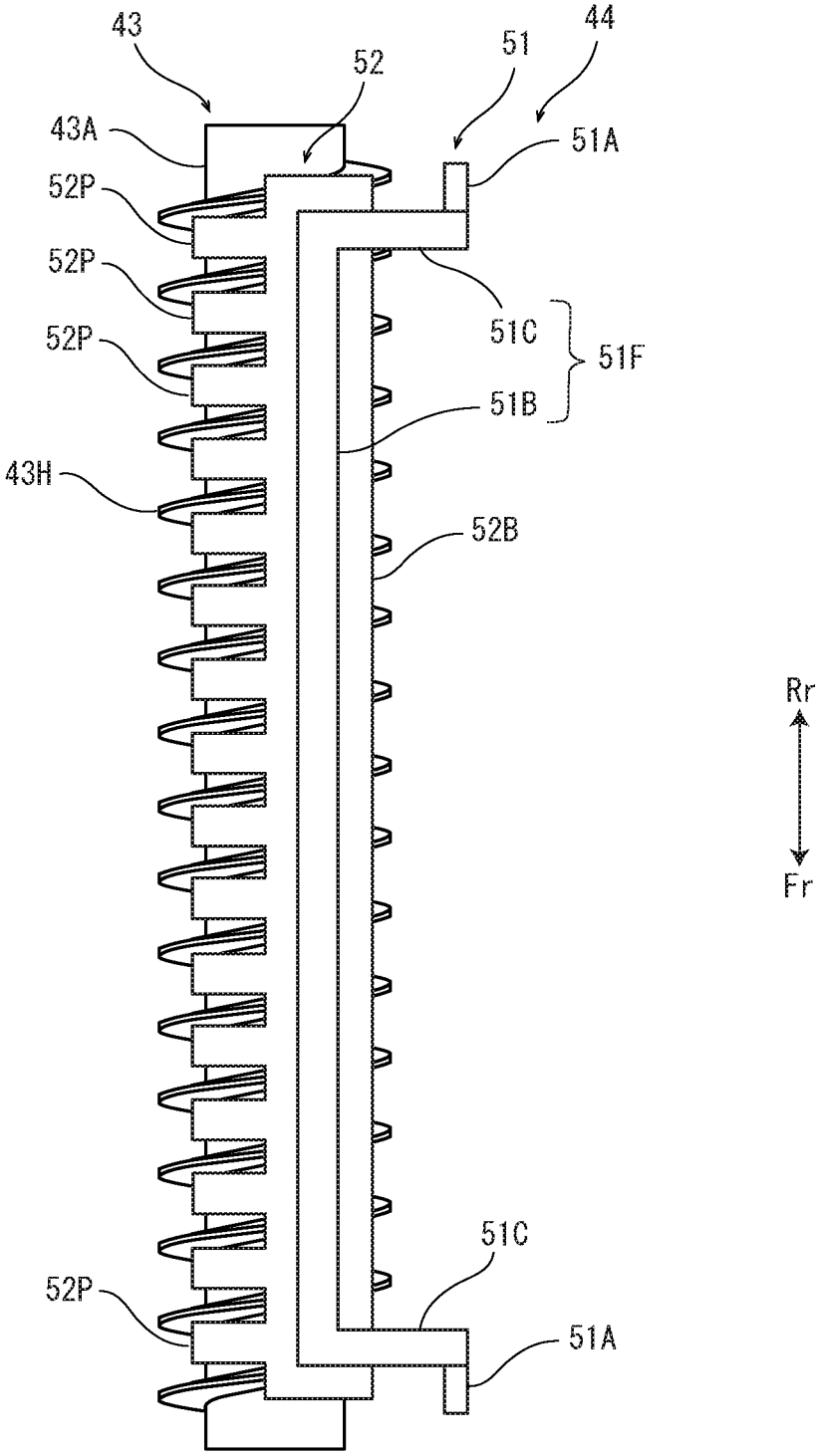
FIG. 4 is a planar view showing the scraping part and a conveying screw as viewed from an A direction in FIG. 2.

Next, with reference to FIGS. 2-4, configurations of the photosensitive drum 21 and the cleaning device 23 will be described. FIG. 2 is a sectional view of the photosensitive drum 21 and the cleaning device 23. FIG. 3 is a planar view of a scraping part 44. FIG. 4 is a planar view showing the scraping part 44 and a conveying screw 43 as viewed from an A direction in FIG. 2.

The photosensitive drum 21 includes a core metal elongated in forward and backward directions as a longitudinal direction, and a photosensitive layer 31 formed on an outer circumferential face of the core metal 30. The core metal 30 is a cylindrical member made of aluminum alloy or the like. The photosensitive layer 31 is made of an amorphous silicon based photosensitive body. The photosensitive drum 21 is supported by a bearing (not shown) fixed to the housing 2, and is driven and rotated in a B direction in FIG. 2 by a driving source (not shown), such as a motor.

The cleaning device 23 includes a cleaning case 41 (an example of a case) storing a waste toner, a cleaning blade 42 butted to the photosensitive drum 21, a conveying screw 43 conveying the waste toner, and a scraping part 44 scraping the toner from the conveying screw 43. The scraping part 44 includes a supporting member 51 and a film member 52.

The cleaning case 41 is made of resin or the like, and houses the conveying screw 43 and the scraping part 44. The cleaning case 41 has an opening 41K at a side of the photosensitive drum 21. On a ceiling part of an inner face of the cleaning case 41, a supporting point part 41S as a rotation supporting point of the scraping part 44 is provided. To the cleaning case 41, a waste toner receptacle (not shown) is connected.

The cleaning blade 42 is made of resin or the like, is attached to a part of the cleaning case 41 at a lower side from the opening 41K, and a distal end of the cleaning blade 42 is butted to the photosensitive drum 21.

The conveying screw 43 is made of resin or the like, and has a shaft part 43A elongated in the forward and backward directions as a longitudinal direction (an axial direction) and a helical blade part 43H formed around the shaft part 43A. The conveying screw 43 is driven by a driving source (not shown), such as a motor.

The supporting member 51 is made of wire material, such as stainless steel. As shown in FIG. 3, the supporting member 51 includes an attaching part 51F to which the film member 52 is attached, and axis parts 51A. The attaching part 51F includes a body part 51B elongated in the forward and backward directions as a longitudinal direction, and intersection parts 51C formed so as to protrude in one direction intersecting the forward and backward directions from a front end and a rear end of the body part 51B. The axis parts 51A are formed in parallel to the longitudinal direction so as to protrude to a front side and a rear side respectively from ends of the front and rear intersection parts 51C at an opposite side to the body part 51B.

The film member 52 is made of PET resin or the like, and has flexibility. The film member 52 includes a base part 52B elongated in the forward and backward directions as a longitudinal direction and having a length approximately equal to the body part 51B of the supporting member 51, and a plurality of protruding pieces 52P formed so as to protrude in one direction intersecting the longitudinal direction from the base part 52B.

The film member 52 is disposed so that the base part 52B of the film member 52 is overlapped with the body part 51B and the intersection parts 51C and that the protruding pieces 52P are protruded in an opposite direction to the intersection parts 51C, and is bonded to the supporting member 51 by using a double-sided adhesive tape, an adhesive agent or the like. The axis parts 51A of the supporting member 51 are formed at ends of the intersection parts 51C at an opposite side to the body part 51B, and the base part 52B of the film member 52 is supported by the body part 51B and the intersection parts 51C.

As shown in FIG. 2, the axis parts 51A of the supporting member 51 are supported by the supporting point part 41S of the cleaning case 41. The scraping part 44 is rotatable around the axis parts 51A supported by the supporting point part 41S. By its own weight of the scraping part 44, a state that the protruding pieces 52P come into contact with the conveying screw 43 is maintained.

Next, cleaning operation of the cleaning device 23 will be described. The toner remained on the photosensitive drum 21 after transferring of the toner image onto the sheet S is scraped by the cleaning blade 42 in accordance with rotation of the photosensitive drum 21, and is stored at a bottom part in the cleaning part 41. On the other hand, by rotation of the conveying screw 43, with regard to the plurality of protruding pieces 52P of the scraping part 44, the blade part 43H of the conveying screw 43 is relatively moved in the longitudinal direction. By this movement, operation of each protruding piece 52P of running on the blade part 43H of the conveying screw 43 and sliding down from the blade part 43H to the shaft part 43A is repeated. By this operation, the toner adhered on the shaft part 43A and the blade part 43H is scraped, and is stored at the bottom part in the cleaning part 41. The stored toner is conveyed in the longitudinal direction of the conveying part 43 by the conveying part 43, and is discharged to the waste toner receptacle.

Figure 5:
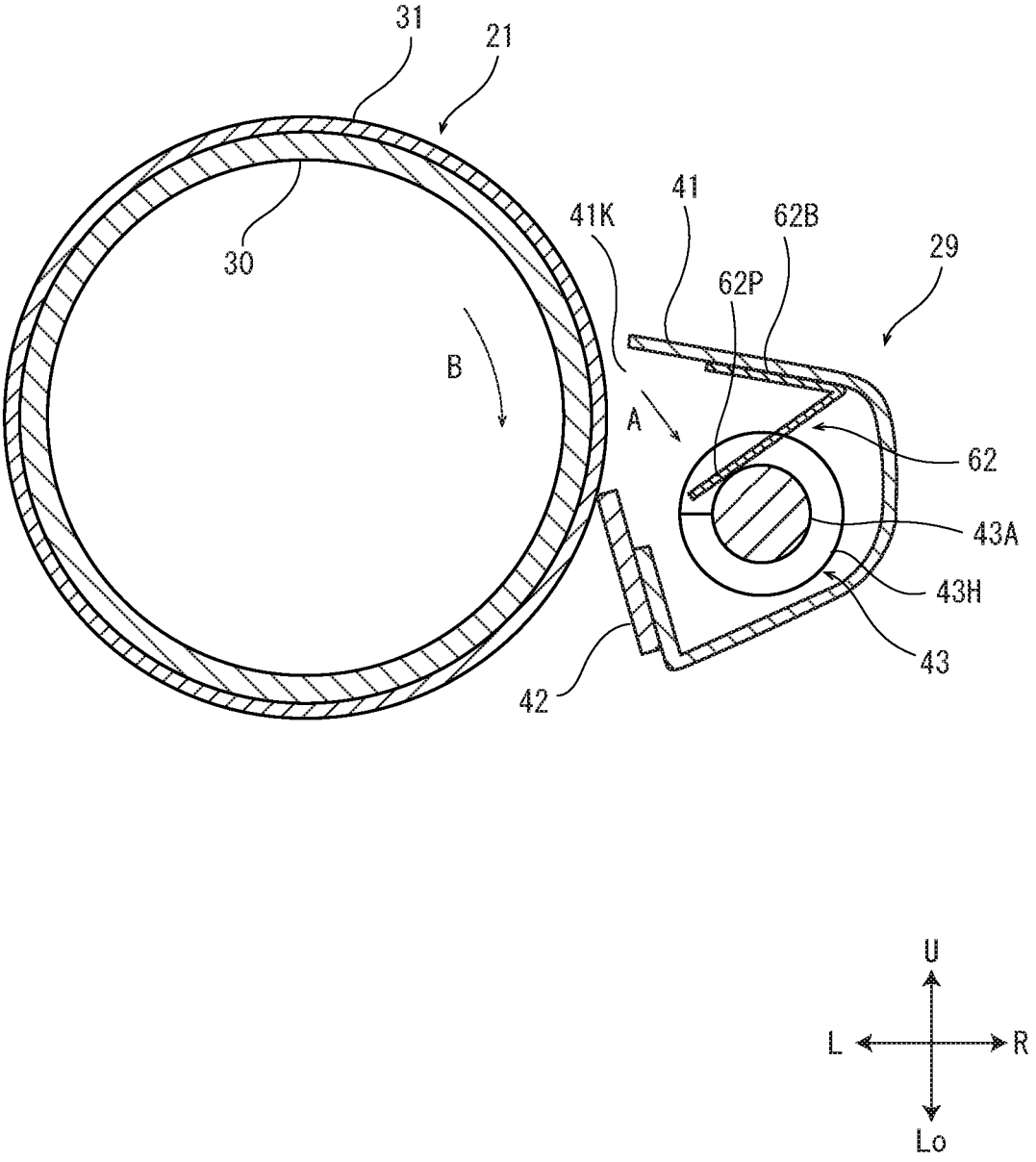
FIG. 5 is a sectional view showing a photosensitive drum and a cleaning device of a comparative example against the embodiment of the present disclosure.
Figure 6:
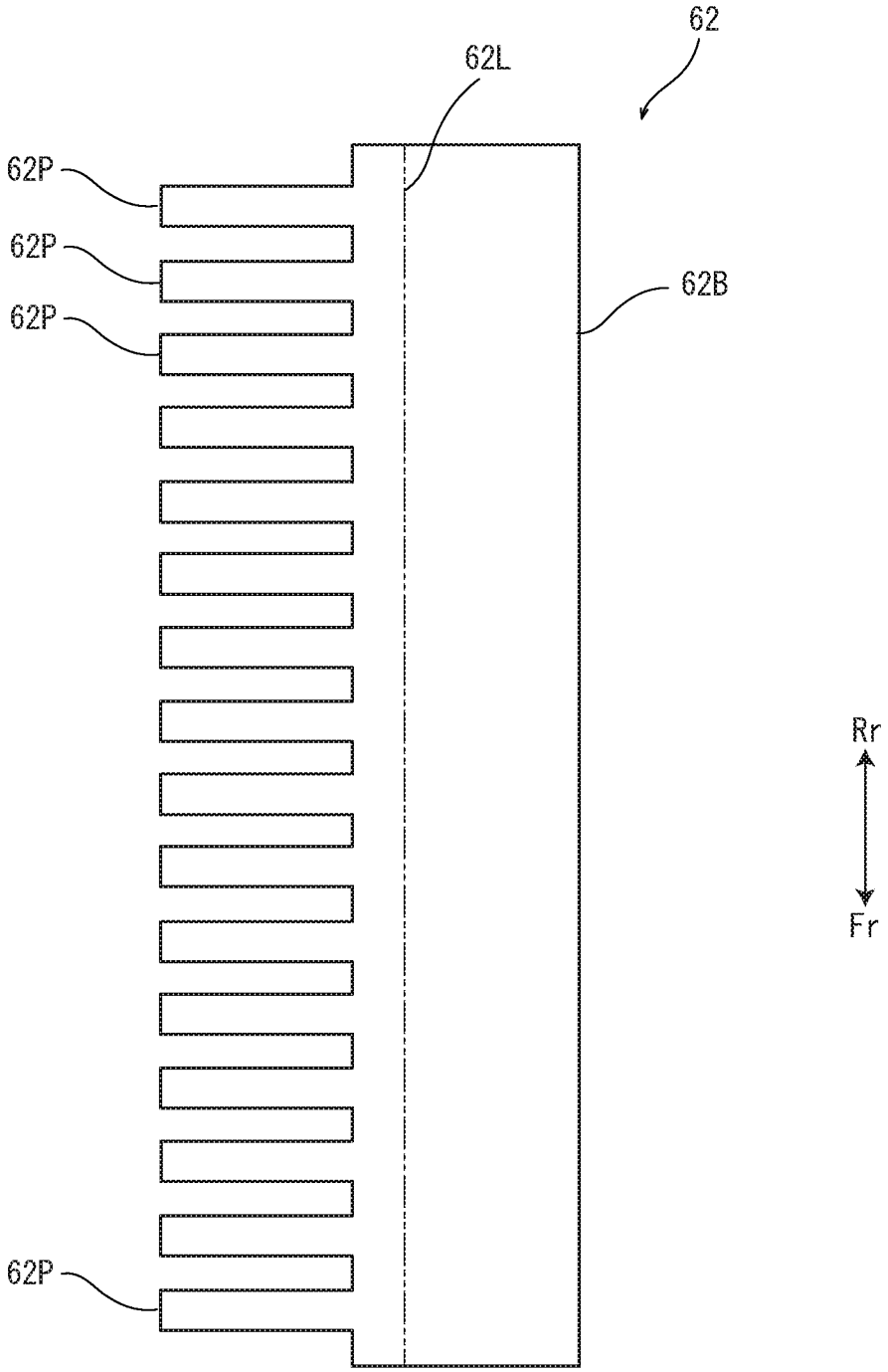
FIG. 6 is a planar view showing a film member of the comparative example against the embodiment of the present disclosure.
Figure 7:
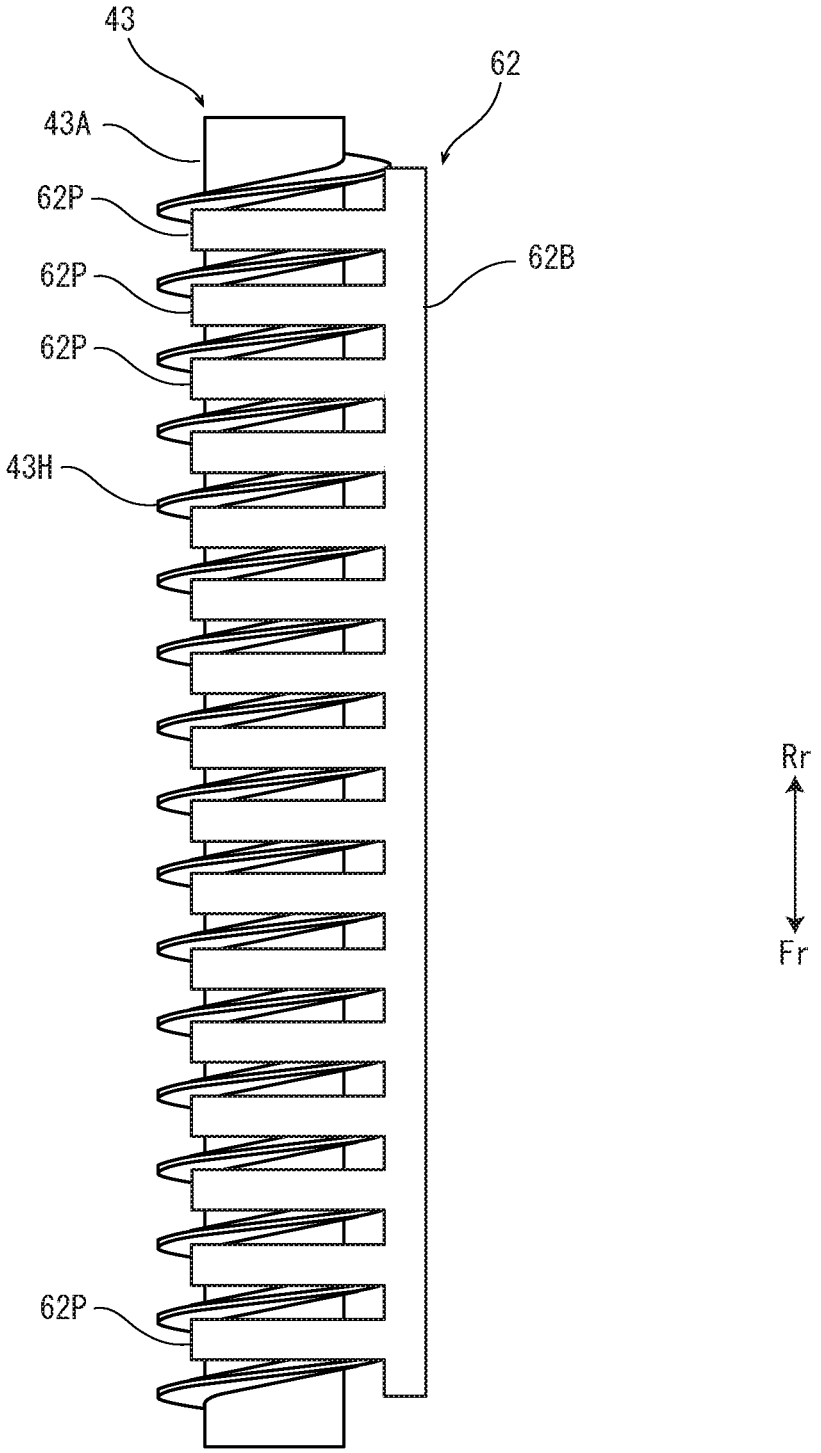
FIG. 7 is a planar view showing the film member and a conveying screw as viewed from an A direction in FIG. 5.

Next, effects of the embodiment will be described by comparing with a comparative example shown in FIGS. 5 to 7. FIG. 5 is a sectional view showing a photosensitive drum 21 and a cleaning device 23 of the comparative example. FIG. 6 is a planar view showing a film member 62 of the comparative example. FIG. 7 is a planar view showing the film member 62 and a conveying screw 43 as viewed from an A direction in FIG. 5.

The cleaning device 23 of the comparative example includes the film member 62 made of PET resin or the like and having flexibility. The film member 62 includes a base part 62B elongated in the forward and backward directions as a longitudinal direction, and a plurality of protruding pieces 62P formed so as to protrude in one direction vertical to the forward and backward directions from the base part 62B. The film member 62 is folded at a position of a folding line 62L indicated by a two-dot chain line in FIG. 6 to make the base part 62B, and is disposed as shown in FIG. 5 so that the protruding pieces 62P are located at an lower side and a part of the base part 62B at a right side from the folding line 62L indicated in FIG. 6 is located at an upper side, and further, an upper part of the film member 62 is bonded onto a ceiling part of an inner face of the cleaning case by using a double-sided adhesive tape, an adhesive agent or the like. Similar to the embodiment, operation of each protruding piece 62P of running on a blade part 43H of the conveying screw 43 and sliding down from the blade part 43H to a shaft part 43A is repeated. By this operation, the toner adhered on the shaft part 43A and the blade part 43H is scraped, and is stored at a bottom part in the cleaning part 41. The stored toner is conveyed in the longitudinal direction of the conveying part 43 by the conveying part 43, and is discharged to a waste toner receptacle.

Toner removing performance of the film member 62 more improves, the stronger pressing force pressing the protruding pieces 62P to the conveying screw 43. In order to strengthen the pressing force, because the base part 62B of the film member 62 is bonded to the cleaning case 41, it is necessary to heighten flexural rigidity (stiffness) of the film member 62 and to enlarge elastic force of the film member 62 against deflection. In order to heighten flexural rigidity of the film member 62, a way of thickening a thickness of the film member 62 may be considered. The thickener the thickness of the film member 62, durability of the film member 62 is more heightened. However, if flexural rigidity of the film member 62 is heightened, it is feared that deflection occurs in the conveying screw 43 because the conveying screw 43 is continuously pressed by elastic force of the film member 62, the blade part 43H of the conveying screw 43 comes into contact with an inner face of the cleaning case 41 to cause allophone, or rotation of the conveying screw 43 is disturbed. By contrast, in order to restrain deflection of the conveying screw 43, if the thickness of the film member 62 is thinned to reduce flexural rigidity, toner removing performance and durability are deteriorated. Therefore, in the comparative example, it is extremely difficult to simultaneously achieve all of improvement of toner removing performance, improvement of durability, and restraining of allophone.

By contrast, since the scraping part 44 of the embodiment is rotatable around the axis parts 51A supported by the supporting point part 41S of the cleaning case 41, the scraping part 44 does not has flexural rigidity practically, and does not resist movement of the blade part 43H. Moreover, in the embodiment, the protruding pieces 62P are pressed to the conveying screw 43 by its own weight of the scraping part 44. Therefore, toner removing performance is more heightened, the heavier the weight of the scraping part 44, and then, toner removing performance can be adjusted by the whole weight of the scraping part 44 (weight of the supporting member and weight of the film member 52). In addition, durability of the film member 52 can be adjusted by a thickness of the film member 52. That is, in the embodiment, it is possible to adjust toner removing performance and durability independently, and such adjustment does not cause deflection in the conveying screw 43.

In accordance with the cleaning device 23 according to the embodiment described above, it is possible to improve adjust toner removing performance and durability of the film member 52, and to restrain deflection of conveying screw 43.

Moreover, in accordance with the cleaning device 23 according to the embodiment, since the film member 52 is supported by the body part 51B and the intersection parts 51C of the supporting member 51, it is possible to restrain rotation of the film member 52 with regard to the body part 52B in comparison with a case where the film member 52 is supported only by the body part 52B.

Further, in accordance with the cleaning device 23 according to the embodiment, since the supporting member 51 is made of metal wire material, it is easy to secure rigidity of the scraping member 44. Moreover, it is easy to adjust weight of the scraping member 44.

The above-described embodiment may be modified as follows.

The attaching part 51F may be made of a rectangular plate shaped material, instead of the body part 51B and the intersection parts 51C.

Although, in the above-described embodiment, an example that the toner conveying device according to the present disclosure is applied into the cleaning device 23, the present disclosure may be applied into the toner container 12 or the developing unit 16.

The present disclosure may be applied to a printer forming a color image by using toners of two colors, three colors, or five or more colors. The present disclosure may be applied to a printer forming a monochrome image by using a toner of one color.

Incidentally, the above-description of the embodiments illustrates one aspect of the cleaning device according to the present disclosure and the image forming apparatus including this cleaning device, but the technical scope of the disclosure is not limited to the above-described embodiments.

The invention claimed is:

1. A toner conveying device comprising:

a case storing a toner;

a conveying screw conveying the toner stored in the case in a predetermined direction inside the case;

a film member including a base part elongated in an axial direction of the conveying screw as a longitudinal direction and a plurality of protruding pieces formed so as to protrude in one direction intersecting the longitudinal direction from the base part, and having flexibility; and a supporting member including an attaching part elongated in the axial direction of the conveying screw as the longitudinal direction to which the film member is attached, and an axis part being in parallel to the longitudinal direction, wherein the film member and the supporting member are disposed at an upper side of the conveying screw so that the protruding pieces come into contact with the conveying screw, and are rotatable around the axis part, the film member and the supporting member compose a scraping part scraping the toner from the conveying screw, the protruding pieces are pressed to the conveying screw by its own weight of the scraping part.

2. The toner conveying device according to claim 1 wherein, the attaching part includes:

a body part elongated in the axial direction of the conveying screw in the longitudinal direction; and intersection parts formed so as to protrude in a direction opposite to the protruding pieces from both ends in the longitudinal direction of the body part, the base part of the film member is attached to the body part and the intersection parts.

3. An image forming apparatus comprising:

the toner conveying device according to claim 2;

an image forming part transferring a toner image formed on an image carrier onto a sheet; and a cleaning blade scraping the toner remained on the image carrier.

4. The toner conveying device according to claim 1 wherein, the supporting member is made of metal wire material.

5. An image forming apparatus comprising:

the toner conveying device according to claim 4;

an image forming part transferring a toner image formed on an image carrier onto a sheet; and a cleaning blade scraping the toner remained on the image carrier.

6. The toner conveying device according to claim 1 wherein, by rotation of the conveying screw, with regard to the protruding pieces of the scraping part, a blade part of the conveying screw is relatively moved in the longitudinal direction, and, by this movement, operation of each protruding piece of running on the blade part of the conveying screw and sliding down from the blade part to a shaft part of the conveying screw is repeated.

7. An image forming apparatus comprising:

the toner conveying device according to claim 6;

an image forming part transferring a toner image formed on an image carrier onto a sheet; and a cleaning blade scraping the toner remained on the image carrier.

8. An image forming apparatus comprising:

the toner conveying device according to claim 1;

an image forming part transferring a toner image formed on an image carrier onto a sheet; and a cleaning blade scraping the toner remained on the image carrier.

* * * * *